United States Patent [19]

Oglesby

[11] Patent Number: 4,903,844

[45] Date of Patent: Feb. 27, 1990

[54] RELEASE COATING ON CIGARETTE CARTON TOP FLAP

[75] Inventor: Robert L. Oglesby, Kernersville, N.C.

[73] Assignee: R. J. Reynolds Tobacco Company, Winston-Salem, N.C.

[21] Appl. No.: 291,798

[22] Filed: Dec. 29, 1988

[51] Int. Cl.[4] ..... B43M 7/00; B65D 3/26; B65D 27/14; A61F 13/02

[52] U.S. Cl. ..... 206/631.1; 229/80; 156/289; 428/40

[58] Field of Search ..... 229/123.3, 132, 182, 229/80, 87 C; 206/631.1, 484.2; 493/264, 265, 266, 394; 53/381 R, 129; 428/202, 352, 40, 346; 156/289, 344, 247

[56] References Cited

U.S. PATENT DOCUMENTS

| | | | |
|---|---|---|---|
| 3,217,871 | 11/1965 | Lee | 206/484.2 |
| 3,410,393 | 11/1968 | Lee | 156/289 |
| 3,511,746 | 5/1970 | Davies | 428/346 |
| 3,525,194 | 8/1970 | Moors et al. | 156/289 |
| 3,608,707 | 9/1971 | Miller . | |
| 3,867,874 | 2/1975 | O'Neil | 493/264 |
| 3,898,114 | 8/1975 | Ward | 156/289 |
| 3,900,642 | 8/1975 | Michel | 156/289 |
| 3,938,659 | 2/1976 | Wardwell | 156/344 |
| 4,020,842 | 5/1977 | Richman et al. | 428/352 |
| 4,241,198 | 12/1980 | Kobayashi | 156/289 |
| 4,296,179 | 10/1981 | Wardwell | 156/344 |
| 4,379,008 | 4/1983 | Gross et al. | 156/247 |
| 4,398,985 | 8/1983 | Eagon | 156/344 |
| 4,426,035 | 1/1984 | Dieckow | 156/289 |
| 4,632,872 | 12/1986 | Gallagher | 156/289 |
| 4,690,322 | 9/1987 | Burns | 229/80 |
| 4,738,391 | 4/1988 | Wiseman | 229/80 |

*Primary Examiner*—Michael W. Ball
*Assistant Examiner*—Louis Falasco
*Attorney, Agent, or Firm*—Grover M. Myers

[57] ABSTRACT

A cigarette carton structure having a releasable adhesive seal to permit reopening of a temporarily sealed carton without damage to the carton. The seal includes a release coating on one of two carton surfaces to be adhesively joined. One of the surfaces may be a top flap and the other surface may be a closure flap. An adhesive is placed on the release coating, and the two surfaces are joined. The release coating may be a weakly cohesive material such as a metallic ink printed on the carton surface so that when the surfaces are separated, the release coating separates without damaging the carton. Alternatively the release surface can be a layer of material that adheres poorly to the adhesive, so that the adhesive readily separates from the release layer. In either case the initial temporary bonding must be sufficiently strong to allow handling, packing and unpacking of the cartons without premature opening.

14 Claims, 1 Drawing Sheet

RELEASE COATING ON CIGARETTE CARTON TOP FLAP

BACKGROUND OF THE INVENTION

The present invention relates, in general, to releasable seals for cartons, and more particularly to a glue release structure for cigarette cartons or similar products, and methods for releasably sealing a carton which must be sealed closed and later reopened without damage to the carton.

Cigarettes are conventionally packaged in packs of 20, with the packs then being placed in cartons of 10 packs by the manufacturer. These cartons are then placed in cases for shipping by the manufacturer to distributors in various states. Since most states collect a tax on the cigarettes which are sold there, each of the cartons must be opened and the state tax stamp placed thereon before they can be sold at retail outlets. Accordingly, the manufacturer must close and seal the cigarette cartons in such a way that they can be readily opened for placement of the tax stamp on the ends of the packs contained in the carton. This reopening of the cartons must be done in such a way, however, that the cartons are not damaged, for if the carton flaps are torn or if a fiber layer is removed, jamming usually occurs in the tax stamping machinery, causing damage to the cigarettes.

The cartons are conventionally formed from carton blanks which include end flaps and a top closure flap. The end flaps are glued together by for example, a polyvinyl acetate emulsion adhesive during the formation of the carton, and this adhesive forms a permanent bond with the carton material. However, the top closure flap cannot be sealed with the end flap adhesive, since attempts to reopen flaps which are secured by this adhesive often results in tearing of the carton fibers. The opening of the carton to allow the application of tax stamps to the cigarette packs in the carton normally is done by jobbers and wholesalers who are licensed by the particular state for this purpose. Since the manufacturer has no control over these individuals, it is necessary to provide a carton which can easily be opened and then resealed without damage.

After the cartons have been filled with cigarette packs by the manufacturer, they must be conveyed to a further packaging station and placed in cases for shipment. Thus, the top flaps of the cartons must be closed and sealed with an adhesive that is sufficiently strong to withstand the necessary handling without opening, yet must be easily reopenable by the jobbers or wholesalers who must place the state tax stamps on the cigarette packs without damage to the carton so that the carton can be resealed for sale. To accomplish this, the top flaps of cigarette cartons presently are sealed with an adhesive which, upon drying, can be fractured so that it will not tear the fibers of the package when the seal is broken but which is strong enough to hold the carton closed during handling. A crystalline glue is used for this purpose.

Typically, the crystalline glue is applied to a sealing surface on the carton, usually on a closure flap which extends the length of the carton, before or after the carton is filled with ciagarette packs. A carton top flap is then folded over the closure flap and when they are brought into contact with each other, the glue temporarily holds the carton in its closed condition. The use of a special crystalline glue or other special adhesive, e.g. hot melt, for this purpose requires that two kinds of glue be applied to the carton blank, however, one kind for the top flap and another kind for the end flaps, thus requiring two adhesive distribution systems and maintenance of two inventories. Furthermore, in order to prevent accidental bonding of the closure flap a coagulating agent is added to the top flap glue. As a result, if the closure flap and end flap glues should become mixed together, the mixture will cease to function as an adhesive. This insures that any end flap adhesive which might inadvertently find its way onto the top flap won't produce a permanent bond between the top flap and the carton surface to which it is to be sealed.

Crystalline glues dry rapidly following application to carton surfaces. This results in a substantial amount of waste in the manufacturing process, since if a carton is not closed within two minutes after glue application, the carton must be rejected. Furthermore, the coagulating agent causes waste disposal problems. Thus, although crystalline glues have the advantage of being easily fractured so that the seal between the top flap and the carton surface to which it is adhered can be readily broken, the use of a special top flap adhesive is expensive and is hard to work with on carton machines, so there are numerous disadvantages to the use of such an adhesive. Accordingly, an improved solution to the problem of providing an easily openable cigarette carton has long been sought.

SUMMARY OF THE INVENTION

The present invention provides a cigarette carton structure which provides a reliable adhesive seal for the top flap of the carton wherein the seal may be readily opened for application of tax stamps to packs within the carton without damage to the fiber material of the carton. This is accomplished through the provision of a release coating on one of the two surfaces which are to be joined in the sealing operation so that the adhesive can be readily detached from that surface and the carton opened. The release coating may be placed either on the inner surface of the top flap which is to contact a corresponding surface on the carton for sealing purposes, or may be placed on the corresponding surface to which the flap is to be attached. The release coating is placed on a relatively small region of the flap surface or the adjacent carton surface, the region being limited to a size that is sufficient to secure the top flap for handling purposes, while permitting release without excessive force when the carton is to be opened.

The release coating preferably is a material having a weak internal coherency after drying. Advantageously, this is a metallic ink and preferably is a gravure-type metallic gold ink. In the preferred form of the invention the coating is printed onto the carton flap which is to be overlaid by a closure flap. The ink may be printed in two small spaced locations which are sufficiently large to permit easy application of dots of adhesive to only the release coating area. The adhesive employed to releasably seal the top flap can then be the same adhesive as that used on the end flaps of the carton, since this adhesive is applied only onto the release layer or to carton locations opposite to, and contacted by, the release layers when the carton is closed. The adhesive must be carefully applied so that the release layer protects the surface of the carton to which it is applied from the adhesive material, thereby ensuring that the adhesive will contact the surface of the carton directly only in the regions corresponding to and directly opposite to the location of the release layer when the carton is closed. Thus, when the carton is closed and temporarily sealed, the adjoining surfaces of the carton in the release region adhere, with the carton fibers being bonded to the adhesive material on one surface and being bonded to the release layer on the other surface. Accordingly, when the carton is supplied to a tax stamp applying machine, the machine can open the carton by prying open the closure flap, causing the release layer, in this case the ink, to release the adhesive which is in contact with it.

When a material having a weakly coherent internal structure, e.g., a metallic ink, is employed as a release layer for an adhesive which bonds the closure flap of a carton, then the opening of the carton flap causes the release layer to break apart, or split internally, so that the bond is broken without damage to the carton. The adhesive remains bonded to the opposed carton surface in the region of the adhesive, but since the release splits apart internally the bond with the opposite carton surface is broken without harm to the opposite carton surface and without tearing the carton flap. Thereafter, the tax stamps can be applied and the carton resealed by applying glue along the closure flap or carton surface in regions not in alignment with or covered by the release layer regions.

The release layer ink spots are positioned for optimum temporary sealing of the carton, and are not used for carton positioning and alignment.

Although a metallic ink which has a poor, or weak internal cohesion is preferred in the present invention, it should be understood that other types of release coatings could be used. For example, weakly internally bonded clay coatings could be used, as well as other materials that are poorly coherent so that an adhesive will bond to the coating for temporary sealing of a package, but where the material of the coating is such that it will not cohere or retain structural integrity under a predetermined separating force and will thus break or split apart, thereby releasing the adhesive. Alternatively, coatings or layers which will poorly adhere to the adhesive, but which will have a temporary bonding effect, may also be used, if desired. Such materials may include silicone coatings, wax coatings, lacquers, varnishes, or the like.

In the preferred embodiment of the invention wherein a weakly internally coherent ink, such as a metallic ink, is employed as the release layer, no additional manufacturing steps are required to provide a carton blank having release layers. The weakly coherent ink layer is simply provided during the carton printing step. Advantageously, the ink employed as the release layer can be the same ink used elsewhere on the carton.

BRIEF DESCRIPTION OF THE DRAWINGS

The foregoing and additional objects, features, and advantages will become apparent to those of skill in the art from a consideration of the following detailed description, taken in conjunction with the accompanying drawings, in which.

DESCRIPTION OF PREFERRED EMBODIMENT

Figure 1:
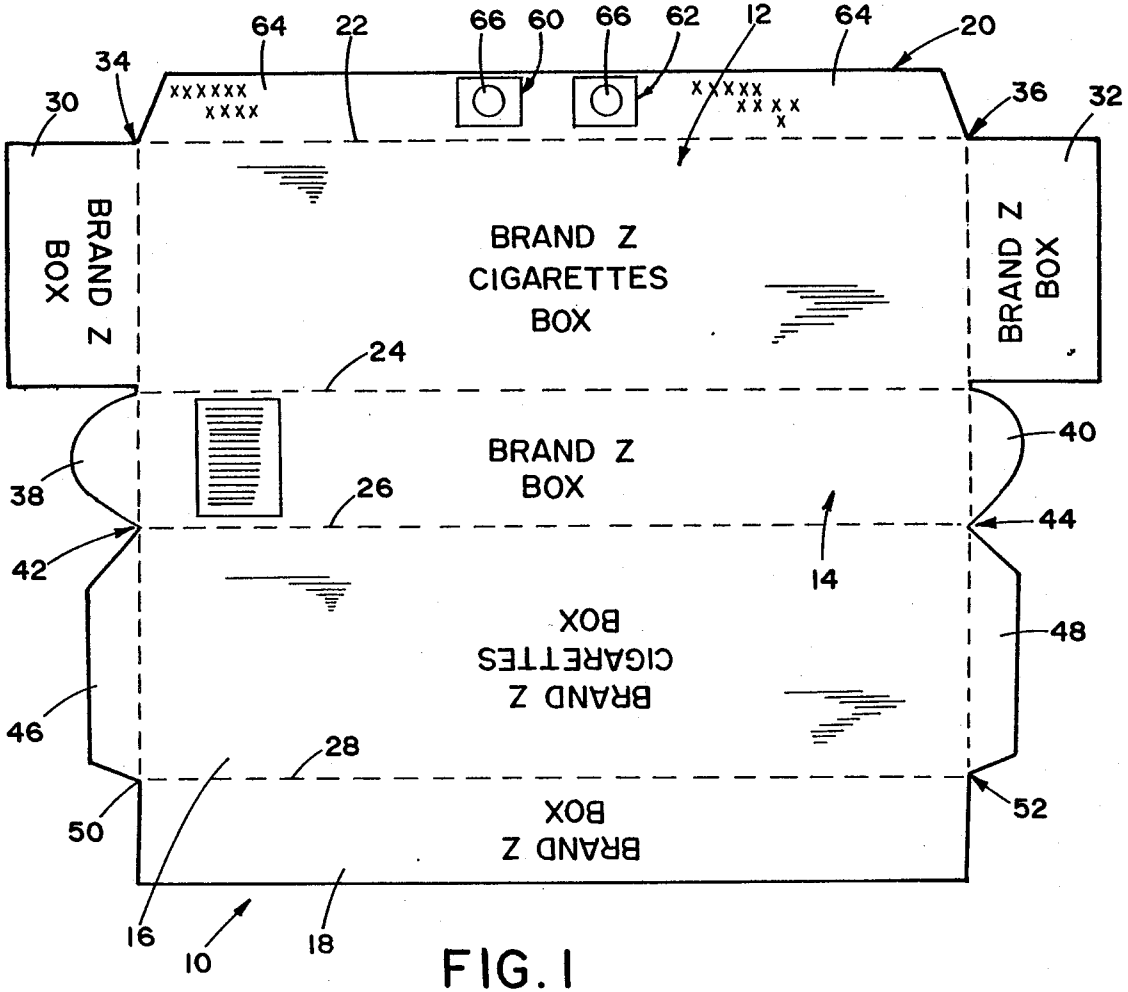
FIG. 1 is a plan view of a carton blank carrying release coatings on limited regions, in accordance with the present invention.

Turning now to a more detailed consideration of the carton construction of the present invention, there is illustrated in FIG. 1 a cigarette carton blank 10 which embodies the features of the present invention. The carton blank may be formed from a suitable material such as paperboard, and includes a front panel portion 12, a bottom panel portion 14, a back panel portion 16 and a top flap 18, which forms the top panel of the carton upon assembly. The top flap 18 overlies a corresponding carton sealing surface to which it is to be sealed to close the carton either temporarily or permanently. This carton sealing surface, indicated at 20, preferably is a second, underlying closure flap which extends the length of the carton and which is connected to panel 12 along a fold line 22. In similar manner, panel 12 is connected to panel 14 by a fold line 24, panel 14 is connected to panel 16 by a fold line 26, and the flap 18 is connected to panel 16 along a fold line 28. As is well known, the cigarette carton is assembled from the blank 10 by folding downwardly, as viewed in FIG. 1, along each of the fold lines to form a generally rectangular carton, with the top flap 18 overlying the sealing surface of closure flap 20. Before assembly, the blank is printed with suitable brand indicia, trade dress for the package, bar code identifying indicia, and the like.

To assemble, the ends of the carton are closed by means of a pair of end flaps 30 and 32 connected at opposite ends of panel 12 by fold lines 34 and 36. A pair of sealing flaps 38 and 40 are formed at the ends of panel 14 and are connected thereto by fold lines 42 and 44, respectively, and additional sealing flaps 46 and 48 are formed at the opposite ends of panel 16 and are connected thereto by fold lines 50 and 52, respectively. These end flaps are folded downwardly along the lines 42, 44, 50 and 52, adhesive is applied thereto, and the end flaps 30 and 32 are folded thereover by folding downwardly along lines 34 and 36, respectively, to contact the sealing flaps and to secure the carton in the assembled, closed position.

The glue applied to the end flaps is a permanent adhesive, since the ends of the carton do not have to be reopened for applying the tax stamps, and such glues are commonly used and well known. However, such a glue cannot be used initially to seal the top flap 18 against the sealing surface of closure flap 20, for such glues are stronger than the paper or cardboard from which the carton is formed, and accordingly any attempt to reopen the carton would result in tearing of the carton fiber and damage to the flap. As noted above, such a fiber-tearing bond on the carton top flap can cause severe product damage during the cigarette tax stamping operation which is carried out after the carton has been shipped by the manufacturer, and accordingly, a release type glue must initially be used to provide a temporary sealing of the carton.

Figure 2:
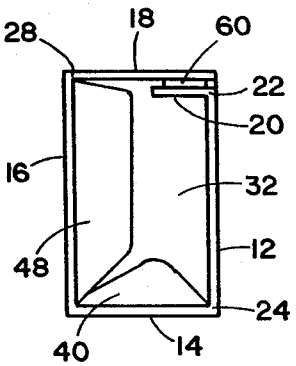
FIG. 2 is a sectional view of an assembled carton made from the blank of FIG. 1.
Figure 3:
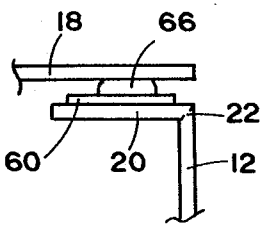
FIG. 3 is an enlarged view of the release coating region of FIG. 2.

In accordance with the present invention, at least one and preferably two or more limited regional areas 60 and 62 on the sealing surface of the closure flap 20 are coated with a layer of a release material. These regional release layers are located along the length of closure flap 20 and are spaced apart slightly to provide the desired grip on the top flap 18 when the carton is sealed. The regional release layers may be any shape, but in the illustrated embodiment are rectangular with their long edges extending longitudinally along the carton length, and with their shorter dimensions extending in the direction of the width of the closure flap 20. These regional areas are slightly smaller than the width of the sealing flap in the preferred form of the invention. Preferably, the regional release layers are formed by printing a metallic ink on the sealing surface of the container blank, for example, on the top surface of closure flap 20 as viewed in FIGS. 1, 2 and 3, preferably at the same time that the brand designation and other decorative displays are printed on the blank. Although the release layers are shown as being located on the top surface of flap 20, it will be understood that they could equally well be positioned on the bottom surface of the top flap 18. However, since it is more convenient to print on a single surface of the carton, the illustrated arrangement is preferred.

No release coating or ink is applied to the sealing surface of flap 20 in the area 64 surrounding the release layers 60 and 62. As a result, after the carton has been opened and tax stamps applied to the packs, these areas can be used as sealing surfaces for receiving permanent glue such as the polyvinyl acetate emulsion used on the end flaps. The cartons are then reclosed and the top flap permanently sealed in place, and the carton is ready for retail sale.

During the initial assembly of the carton, permanent adhesive is applied to the end flaps, as previously discussed, and at the same time spots of the same adhesive are applied to the top surfaces of the release layers 60 and 62. Preferably, the adhesive is applied in a circular dot pattern, as illustrated at 66, near the center of each release layer. The sizes of the applied dots of adhesive are sufficiently small to insure that the adhesive does not flow over the sides or ends of the release layer regions 60 and 62. On the other hand, it will be understood that sufficient glue must be applied to provide an initial temporary seal of the carton so that after cigarette packs are placed in a carton, it may be temporarily closed and "tacked" in place. The temporary seal must have sufficient strength to hold the carton closed throughout the necessary handling procedures that are required, including transferring the carton to a packing area where it is placed in a case for shipment to a jobber, removing the carton from the case, and transporting the carton to a tax stamp applying machine where it is opened. In accordance with the preferred form of the invention, opening the carton breaks or splits apart the release layer when the carton top flap 18 is pried away from the sealing surface of closure flap 20 and the adhesive stays with the top flap.

Upon examination of the carton sealing surfaces, on the under surface of the top flap 18 and on the top surface of the closure flap 20, it will be seen that both the adhesive material which remains with the top flap and the opposed surface of the closure flap, in the regional area where the release layer was initially applied, remain coated with a thin layer of the release material. This separation of the release layer ensures that the carton will not be damaged during the opening operation, so that it will pass through the tax applying machinery and can be permanently closed and sealed thereafter.

As indicated previously, any of various inks of poor internal coherency may be used as the release layer. Such inks may include metallic inks, either solvent-based gravure inks or oil based letter press inks, including inks such as Thiele-Engdahl SDM 8909, a styrene based metallic gravure ink (available from Thiele-Engdahl, Inc. Winston-Salem, N.C.), similar urethane based inks, and the like. Other release layers which adhere strongly to the carton flap but only weakly to the carton adhesive may also be used.

An example of a suitable metallic ink is the gold ink identified above as SDM 8909, which has the following characteristics:

| PROPERTY DESCRIPTION | UNITS | NOMINAL VARIANCE |
|---|---|---|
| Viscosity @ 25° C. #3 Zahn Cup | seconds | 23 ± 3 |
| Viscosity Reduction #2 Zahn 100 Parts Ink 30 Parts Toluene | seconds | 20 ± 2.0 |
| Particle Size | | No retains on 325 mesh screen |
| Fineness of Grind | mils | .3 0.4 Maximum |
| Total Solids | percent | 47.2 ± 2.0 |
| Weight per gallon | pounds | 10.5 ± 0.2 |
| Solvents Present | percent | |
| Toluene | | 100.0 ± 3.0 |

Although the present invention has been disclosed in terms of a preferred embodiment thereof, it will be apparent that numerous modifications and variations can be made without departing from the true spirit and scope thereof as set forth in the following claims.

What is claimed is:

1. A releasably sealed container, comprising:

a carton blank having side walls, end flaps, a top flap, and an opposed closure portion for sealingly engaging said top flap;

an adhesive-releasing layer formed on at least one predetermined region of one of said top flap and carton closure portion;

permanent adhesive means for sealing said end flaps upon assembly of said carton;

a permanent adhesive layer on only said adhesive releasing layer and in an area out side of said region of the top flap and the carton closure portion opposite to said adhesive releasing layer, said permanent adhesive layer bonding to said top flap and the opposed closure portion in the region of said adhesive-releasing layer to initially releasably seal said carton closure upon closing of said top flap;

wherein at least a portion of the remaining area outside of the region of said top flap and closure portion surrounding said region having adhesive-releasing layer form a permanent adhesive receiving area for permanently resealing said carton top flap to the closure after release of said initial seal.

2. The container of claim 1, wherein said releasing layer is a weakly cohesive metallic ink.

3. The container of claim 1, wherein said releasing layer is a silicone coating.

4. The container of claim 1, wherein said releasing layer is a wax-containing coating.

5. The container of claim 1, wherein said releasing layer is a weakly bonded clay coating.

6. The container of claim 1, wherein said releasing layer is formed on two spaced apart regions, said regions having a sufficiently large area to permit adhesive applied thereto to secure said top flap in place during handling of said carton.

7. The container of claim 6, wherein said releasing layer locations are on said carton closure portion.

8. The container of claim 6, wherein said carton closure portion comprises a closure flap which is overlapped by said carton top flap to close and seal said carton.

9. The container of claim 6, wherein said adhesive means for sealing said end flaps and said adhesive layer are the same adhesive material.

10. The container of claim 6, wherein said adhesive means comprises a dot of adhesive on said releasing layer.

11. A releasable seal for a cigarette carton having bottom and first and second side wall portions, sealable end flaps at the opposite ends of said wall portions, a closure flap connected along the length of one edge of said first side wall and a top flap connected along the length of one edge of said second side wall, said top flap having a lower surface overlapping and contacting an upper surface of said closure flap to close said carton, the releasable seal comprising:

at least one adhesive releasing layer covering a predetermined region of one of said overlapping surfaces;

a quantity of permanent adhesive located on said adhesive-releasing layer and on the overlapping surface opposite to said adhesive-releasing layer, said permanent adhesive bonding said overlapping surfaces to temporarily hold said carton closed, said releasing layer permitting reopening of said carton without damage to said top flap or said closure flap;

wherein the surface of said one of said overlapping surfaces which surrounds said predetermined region covered by said releasing layer is free of said releasing layer and provides an area for receiving permanent glue for permanently resealing the top flap to the closure flap.

12. The carton of claim 11, wherein said adhesive-releasing layer is located on said closure flap.

13. The carton of claim 12, wherein said adhesive is located on said releasing layer prior to closure of said carton, and upon closing of said carton, temporarily bonds said top flap to said closure flap.

14. The carton of claim 12, wherein said releasing layer is a layer of weakly cohesive material, whereby said carton is openable by separating said top flap from said closure flap to thereby separate said releasing layer.

* * * * *